US006041635A

United States Patent [19]

Cattaneo et al.

[11] Patent Number: 6,041,635

[45] Date of Patent: Mar. 28, 2000

[54] UNIT FOR ROLLING PIPES ON A MANDREL

[75] Inventors: Filippo Cattaneo; Roberto Brioschi; Ettore Cernuschi, all of Milan; Paolo Marin, Pavia; Luciano Calcinati, Milan; Maurizio Brignoli, Bergamo, all of Italy

[73] Assignee: Demag Italimpianti S.p.A., Italy

[21] Appl. No.: 09/077,640

[22] PCT Filed: Oct. 10, 1996

[86] PCT No.: PCT/EP96/04387

§ 371 Date: Nov. 30, 1998

§ 102(e) Date: Nov. 30, 1998

[87] PCT Pub. No.: WO97/19767

PCT Pub. Date: Jun. 5, 1997

[30] Foreign Application Priority Data

Nov. 29, 1995 [IT] Italy ..... MI95A2492

[51] Int. Cl.[7] ..... B21B 13/12

[52] U.S. Cl. ..... 72/235; 72/237; 72/239

[58] Field of Search ..... 72/235, 237, 238, 72/239, 234

[56] References Cited

U.S. PATENT DOCUMENTS

| | | | |
|---|---|---|---|
| 4,274,274 | 6/1981 | Zacharias et al. | 72/239 |
| 4,366,694 | 1/1983 | Pariseau et al. | 72/235 |
| 4,478,065 | 10/1984 | Gancia et al. | 72/239 |
| 5,331,835 | 7/1994 | Palma et al. | 72/234 |
| 5,765,423 | 6/1998 | Cattaneo et al. | 72/237 |

FOREIGN PATENT DOCUMENTS

| | | |
|---|---|---|
| 0 565 772 | 10/1993 | European Pat. Off. . |
| 0 593 709 | 4/1994 | European Pat. Off. . |
| 2 527 948 | 12/1983 | France . |
| 2 004 220 | 3/1979 | United Kingdom . |
| 2 100 160 | 12/1982 | United Kingdom . |
| 2 129 722 | 5/1984 | United Kingdom . |
| 2 151 171 | 7/1985 | United Kingdom . |

OTHER PUBLICATIONS

PCT International Search Report dated Mar. 12, 1997in International Application PCT/EP96/04387.

*Primary Examiner*—Ed Tolan

*Attorney, Agent, or Firm*—Jeffer, Mangels, Butler & Marmaro LLP

[57] ABSTRACT

A rolling mill for rolling pipes on a mandrel (40) is formed by an alignment of rolling units according to the invention, each rolling unit comprises an outer annular structure (2) formed by at least two plate-shaped elements (3) connected rigidly to one another and housing a roll carrier (10) on which the rolling units (27,28,29), supported by respective pivoting lever arms (19,20,21), are disposed. Each roll carrier (10) can be removed transversely from its rolling unit which, for this purpose, is provided with guides (15) in addition to a loading-unloading device (50) on which the removed carrier is placed. The outer annular structure (2) enables the rolling unit and the corresponding rolling mill better to withstand the radial stresses produced during working, the replacement of the rolls of the respective carriers (10) at the same time being simplified by virtue of their lateral movement.

20 Claims, 7 Drawing Sheets

UNIT FOR ROLLING PIPES ON A MANDREL

TECHNICAL FIELD

The invention relates to a unit for rolling pipes on a mandrel, of the type indicated in the preamble to the first claim hereinbelow appended; the invention also relates to a rolling mill which comprises a plurality of these rolling units.

BACKGROUND ART

The rolling units referred to above, in addition to the rolling mills formed by these rolling units arranged in alignment along a longitudinal rolling axis, are already known from the Applicant's published Italian patent application No. MI92A000917 (corresponding also to European patent application No. 92118389.3); in short, this rolling unit permits the use of at least three driven processing rolls, combining the advantageous effects resulting from this fact with considerable functional flexibility which facilitates the various maintenance and roll-replacement operations. This result is indeed achieved by virtue of the fact that the rolls are mounted on a suitable carrier which can be removed from the structure of the rolling mill, and that the rolls are arranged on pivoting lever arms so that their distance from the rolling axis can be adjusted; in a rolling mill of this type, the stresses generated during the rolling of a pipe fitted on a mandrel are transmitted to the outer load-bearing structure by the elements which support the rolls on each arm, through the device for adjusting the positions of the rolls; the load-bearing structure is constituted, for each rolling unit of the rolling mill, by at least two plate-like elements in the form of circular rings joined together by a series of spacers, these elements rigidly supporting a fixed portion of the device for adjusting each roll.

The outer load-bearing structure is therefore substantially tubular and can effectively absorb the rolling stresses mentioned, precisely by virtue of its closed shape concentric with the rolling axis.

Maintenance of the rolling mill or changing of the rolls, for example, in order to turn them again, are carried out by the removal of all of the roll carriers from the structure of the rolling mill, the carriers being slid axially relative to the structure on suitable guides provided therein and then deposited on a carriage arranged at the output end of the rolling mill for moving the carriers; in a solution of this type, the space downstream of the rolling mill has to be at least equal to the length of the pack of carriers inside the rolling mill to allow the carriers to be positioned on the carriage for moving them. This is not always the case in actual rolling plants since the arrangement (layout) of the various rolling mills (roughing, finishing, etc.) required for carrying out the various stages of the processing of a finished pipe from a billet is such that there is not always sufficient space downstream of a rolling mill such as that considered above for the roll carriers to be removed in accordance with the teaching mentioned.

For this reason, a variant of the rolling unit and of the respective rolling mill just mentioned has therefore been provided and is described and illustrated in published Italian patent application No. MI93A000704 (corresponding also to PCT international application No. EP93/00898) also by the present Applicant. In this variant, the outer structure of the rolling unit is substantially "C"-shaped, that is, open on one side in a radial direction relative to the rolling axis; for rolling-mill maintenance and roll-replacement operations, the carriers on which the rolls are mounted are removed from the load-bearing structure in the aforementioned radial direction by being slid on suitable guides provided in each rolling unit.

This second technical solution is particularly suitable for processing pipes or even rod-shaped bodies and bars, wherein which a mandrel is not used since, because the load-bearing structure of each rolling unit is open laterally, it does not offer the same capacity as the substantially tubular structure described above to contain the rolling stresses mentioned which are transmitted from the mandrel by means of the rolls and the support elements mounted on the pivoting arms.

Disclosure of the invention

The object of the present invention is to devise a rolling unit, as well as a respective rolling mill formed by a plurality of such units, which have structural and functional characteristics such as to combine the advantageous effects demonstrated by the embodiments of the two applications mentioned above; in other words, the invention envisages the provision of a rolling unit and of a respective rolling mill which can contain and withstand the stresses that act on the outer load-bearing structure as a result of the use of the mandrel during rolling, as well as enabling maintenance and roll-changing operations to be carried out by the lateral removal of the respective support carriers from the outer load-bearing structure.

This object is achieved by a rolling unit and a corresponding rolling mill characterized in the claims appended to this description.

BRIEF DESCRIPTION OF THE DRAWINGS

For a better understanding of the invention, its characteristics and the advantageous effects achieved thereby, a description of a preferred but not exclusive embodiment thereof is given below and illustrated in the appended drawings, in which.

BEST MODES OF CARRYING OUT THE INVENTION

Figure 1:
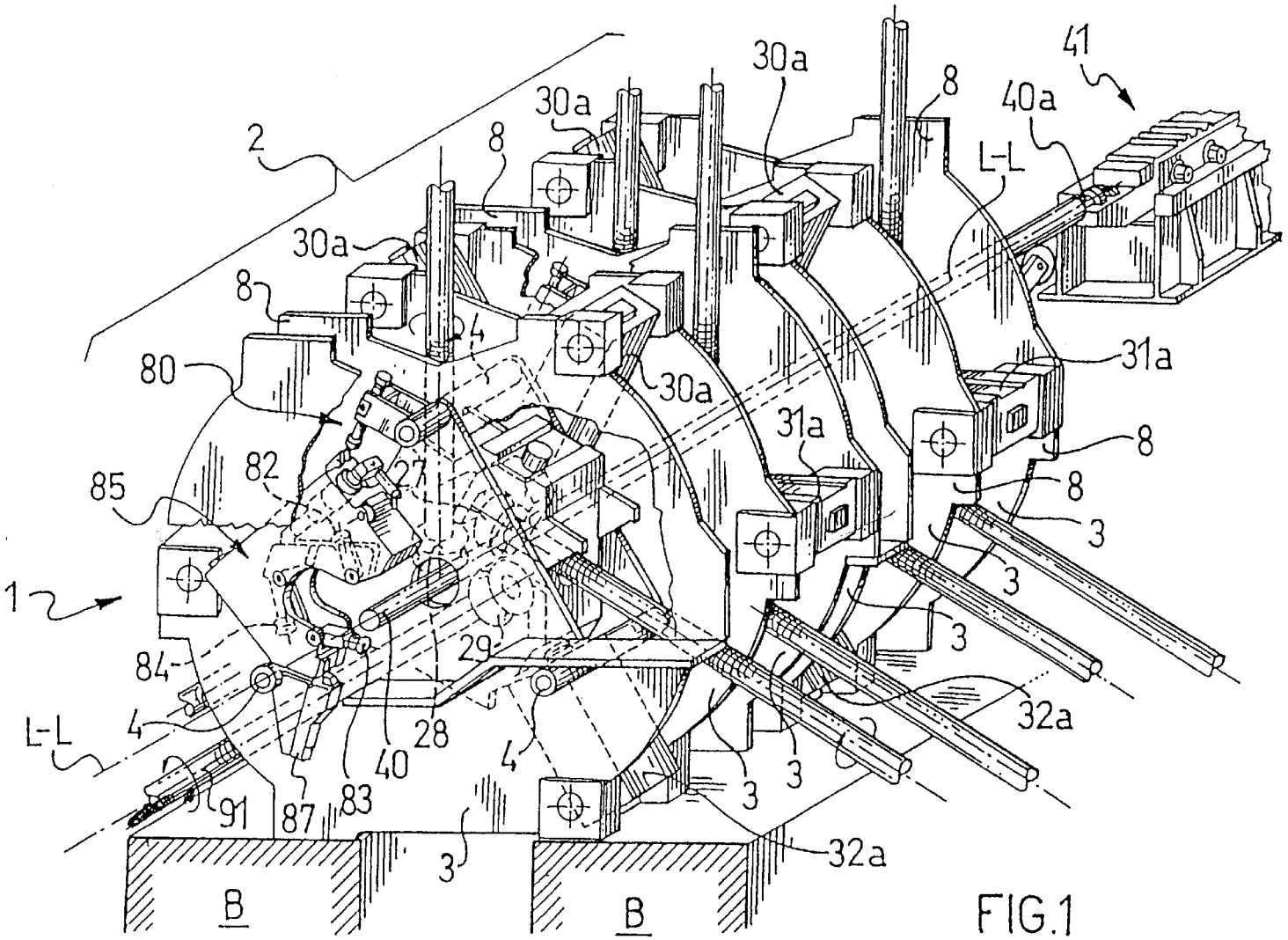
FIG. 1 is a schematic view of a rolling mill formed according to the invention.
Figure 2:
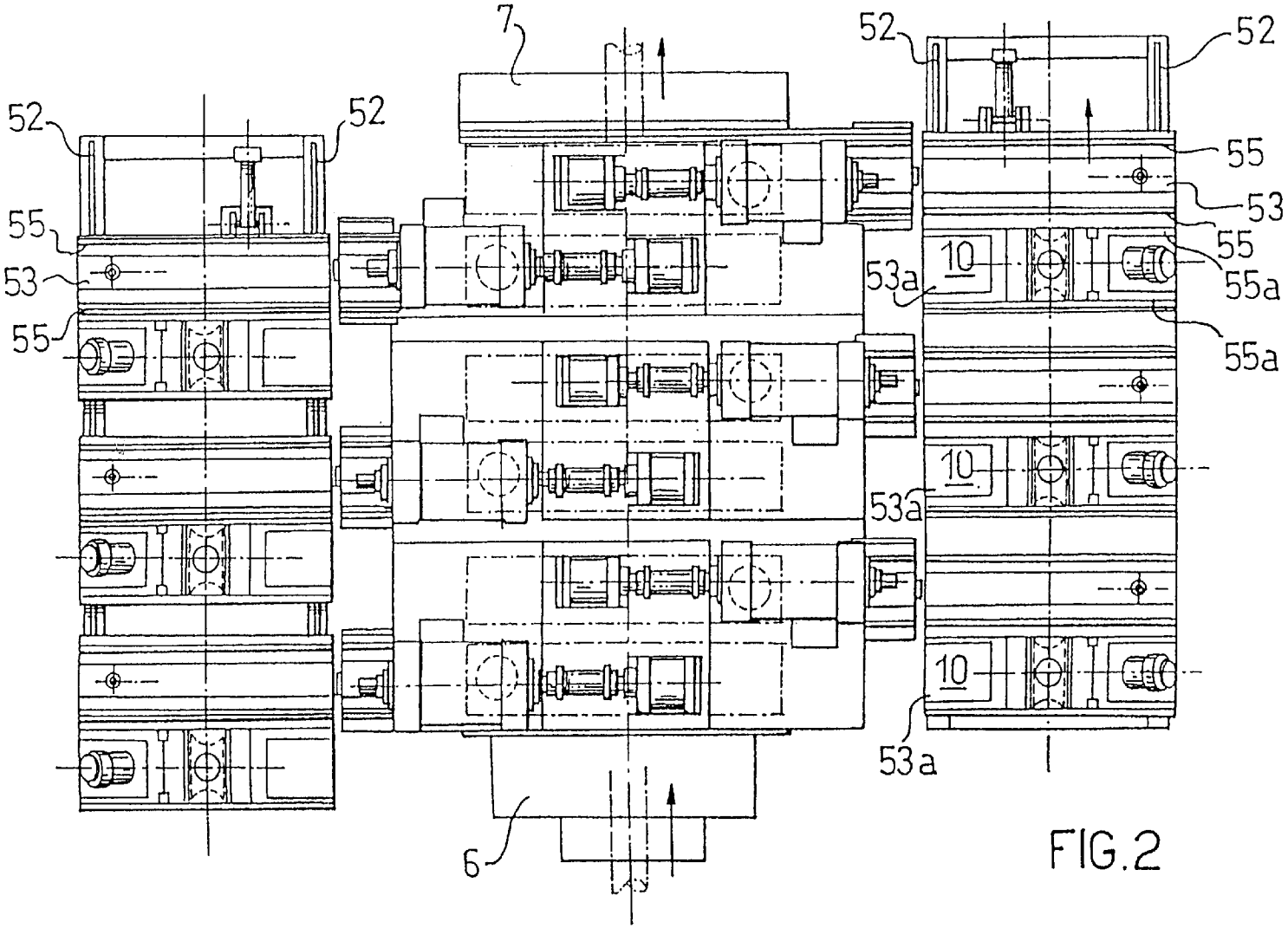
FIG. 2 is a plan view of the rolling mill of FIG. 1.

With reference to these drawings, therefore, a rolling mill for processing pipes on a mandrel according to the invention is generally indicated at 1; it has an outer structure 2 which is disposed concentrically to a rolling axis L and is supported on a base B; the structure 2 is constituted by a plurality of plate-like elements 3 which, as will be described further below, are connected rigidly to one another by means of tie rods 4 and are part of the respective outer structures of a plurality of rolling units 5 aligned along the longitudinal axis L between an input end 6 and an output end 7 for the pipes being processed. These ends 6 and 7 are at opposite ends of the structure 2, respectively.

As stated above, each rolling unit 5 according to the invention comprises a pair of plate-like elements 3 disposed side by side and connected to one another by the tie rods 4 in the general structure 2; more particularly, in this embodiment, the plate-like elements 3 are in the form of substantially circular rings or, in any case, closed rings, on the outer edges of which there are some appendix 8 which will be considered further below, together with other structural details of the invention; in practice, therefore, two consecutive, rigidly interconnected elements 3 in the rolling mill define an outer support structure of each rolling unit. In the rolling mill of this embodiment, all of the rolling units with the respective support structures are connected to one another without loss of continuity and the two faces of a single plate-like element 3 are therefore parts of respective adjacent units along the rolling axis L.

Each rolling unit 5 has a respective roll carrier 10 in the form of a substantially triangular, or in any case closed, annular frame which is housed between two consecutive plate-like elements 3 in the rolling mill 1; for each rolling unit there are also removable means for locking the carrier in the working position adopted during the rolling of a pipe.

Three pins 11, 12, 13 are fixed to each roll carrier 10 at the vertices of an equilateral triangle inscribed in the cross-section of the carrier and respective lever arms 19, 20, 21 are mounted thereon. The pins 11, 12, 13 constitute fulcrums about which the corresponding lever arms 19, 20, 21 pivot and are fixed to the roll carrier 10 in a known adjustable manner for which reference should be made to the patent applications of the prior art already cited.

In the embodiment of the invention described herein the arms 19, 20, 21, each of which is constituted by two parallel and opposed plate-shaped half arms, pivot in a plane perpendicular to the rolling axis L; alternatively, however, they could be formed so as to pivot in respective radial planes, each perpendicular to the axis of rotation A1, A2 or A3 of the corresponding roll and extending through the rolling axis. This teaching in fact prevents the longitudinal elongation of the arms due to the high temperatures which sometimes occur during rolling from adversely affecting the positioning of the rolls relative to the axis L; on the basis of this teaching, the pivoting of the lever arms 19, 20, 21 in fact always takes place in the radial planes mentioned, which are perpendicular to those where the arms pivot in the embodiment shown in the drawings, even in the event of their elongation due to thermal deformation.

Respective support elements 24, 25, 26, fixed at the end of the arms 19, 20, 21 opposite to that mounted on the pins 11, 12, 13, support corresponding rolls 27, 28, 29 each rotatable about its own rotation axis A1, A2 or A3 transverse the rolling axis L.

Figure 3:
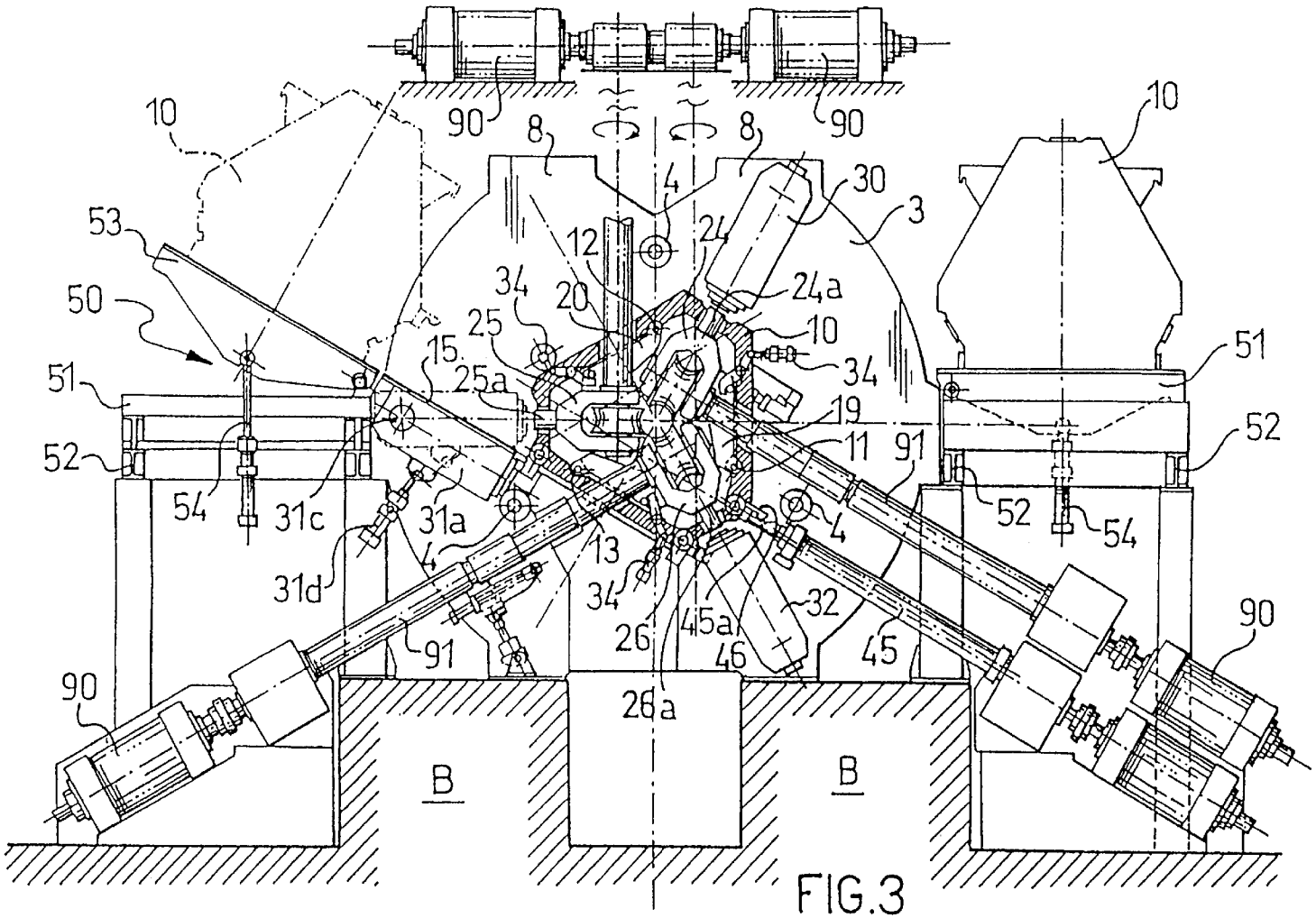
FIG. 3 is a schematic view of the above-mentioned rolling mill, partially sectioned transversely.

In a preferred embodiment of the invention, the support elements are mounted on the ends of the arms in a frontally adjustable manner; an example of this adjustable mounting is described and claimed in Application MI92A000917 already cited, where it is achieved by means of bolts and slotted holes (see FIG. 3 of this application) which are also applicable in this case; naturally, however, other solutions should not be excluded.

For each roll 27, 28 or 29 in each rolling unit 5, there is a device 30, 31 or 32 for adjusting the distance of the respective axis of rotation A1, A2 or A3 from the rolling axis L; this device acts on support means of the rolls 27, 28, 29 which, as seen above, include the arms 19, 20, 21 with the support elements 24, 25, 26.

In this embodiment of the invention, the adjustment devices 30, 31, 32 are preferably hydraulic and each comprises an oleodynamic cylinder-piston unit constituted essentially by a respective fixed portion, 30*a*, 31*a* or 32*a* connected rigidly to the outer structure 2 of the rolling mill between a pair of adjacent plate-like elements 3 in the region of the appendix 8 on the outer edges thereof, and a movable portion 30*b*, 31*b* or 32*b* which can slide back and forth relative to the aforesaid fixed portion along a radial axis passing through the rolling axis L and arranged at 120° to the other two homologous axes.

In fact it should be noted, with regard to the adjustment device 31, that its fixed portion 31*a* is mounted rotatably on a pin 31*c* fixed between two plate-like elements 3 of a rolling unit 5; this adjustment device 31 is associated with an actuator 31*d* acting on the fixed portion 31*a* in order to rotate the latter about the pin 31*c* between an operative position in which the movable portion 31*b* is slidable along the radial axis extending through the rolling axis and arranged at 120° to the other two mentioned above, and an inoperative position in which the adjustment device 31 is retracted relative to a pair of guides 15 arranged transverse the rolling axis. These guides extend parallel to one another and are fixed to respective plate-like elements 3 of a rolling unit; the direction of sliding of the movable portion 31*b* is thus defined when the fixed portion 31*a* is in the operative position.

The movable portion 30*b*, 31*b* or 32*b* of each adjustment device acts on a spacer 24*a*, 25*a* or 26*a* of each support element 24, 25 or 26, the spacer extending through a corresponding hole 33 passing through the roll carrier 10, throughout its thickness, and is situated at a respective vertex of the triangular shape of the carrier. Moreover, suitable biasing means 34 of known type, constituted by a lever mechanism operated by a small hydraulic cylinder, compensate for the weight of each roll 27, 28 and 29 as well as that of the respective support elements and of the support arms 19, 20 and 21. These biasing means enable the rolls of each rolling unit to be kept in a rest position wherein which they are spaced from the rolling axis so as to be ready to receive a pipe being processed, when it reaches the unit.

As will become clearer from the following description, the biasing means 34 associated with the arm 20, that is, the arm on which the adjustment device 31 acts, can move from the arrangement in which it holds the roll in the rest position, in order to allow the corresponding carrier 10 to come out.

The roll carriers 10 are housed in the structure 2 of the rolling mill of the invention in a manner such that, as already stated, the sliding axes of the movable portions 30*b*, 31*b* and 32*b* of the adjustment devices associated with a roll carrier 10 are disposed at 120° to one another and are offset by 60° relative to the analogous axes of the movable portions of the devices 30, 31 and 32 associated with the adjacent roll carrier in the rolling mill.

Figure 5:
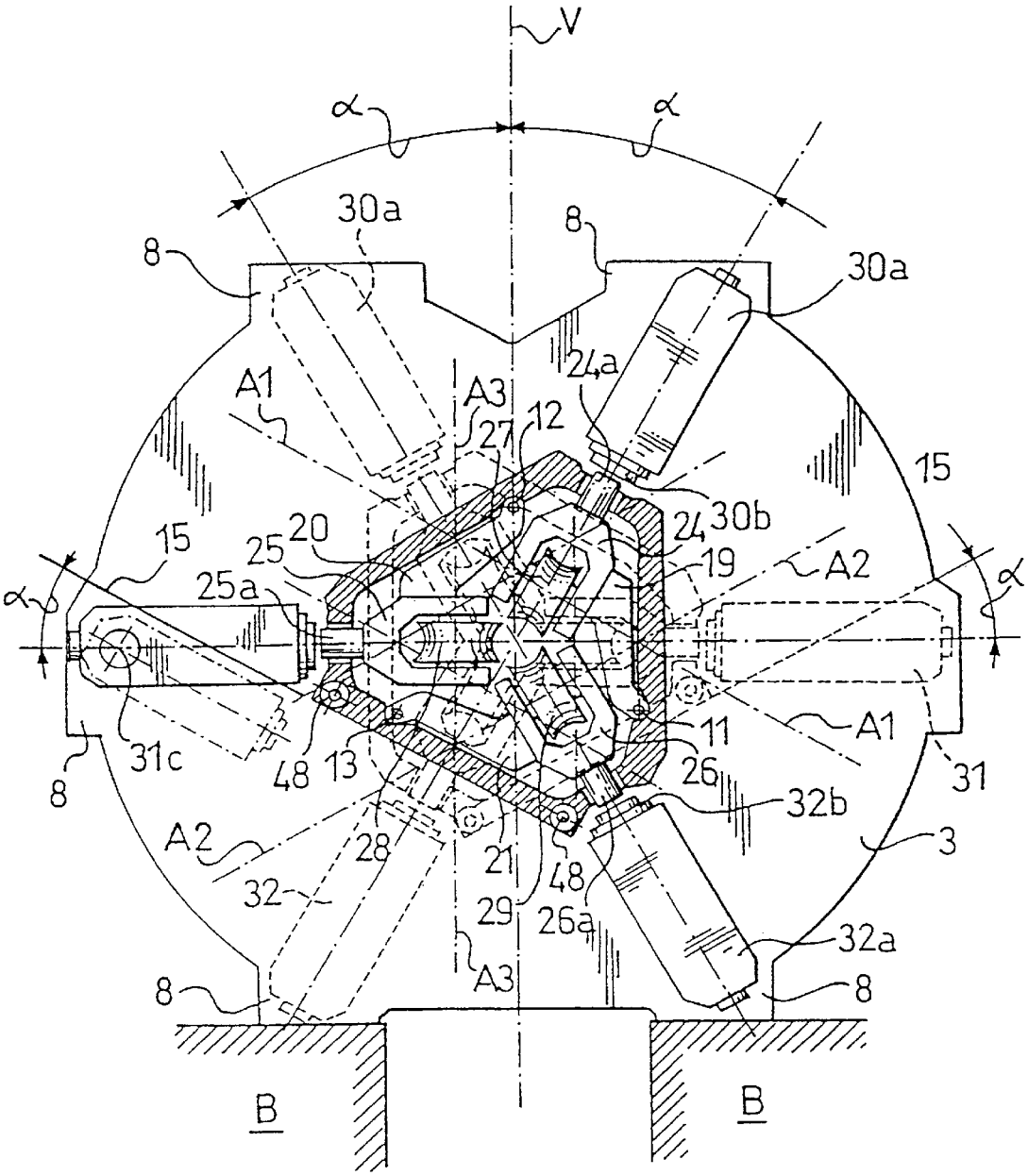
FIG. 5 is a schematic view of some details of FIG. 3, FIGS. 6, 7 and 8 show a detail of the rolling mill of the preceding drawings, in respective operative conditions.

The offset arrangement referred to above (which is visible in FIG. 5) is linked with that of the axes A1, A2 and A3 of a corresponding set of three rolls which, except for their displacement during rolling due to the pivoting of the respective arm, are oriented at 60° to one another, like the sides of an equilateral triangle; this fact, together with the particular arrangement of the sliding guides 15 of a carrier for each rolling unit, confers an advantageous symmetry on the rolling units with respect to a vertical axis V extending through the rolling axis (see FIG. 5, where an angle of 30° is indicated $\alpha$).

In the rolling mill 1 there is also a mandrel 40 which is moveable along the rolling axis L and is driven by a mandrel-holder 41 shown schematically in FIG. 1; in this embodiment, the rolling mill is of the type with a mandrel held by means of a shaped tang 40*a* provided for connection to the mandrel-holder 41.

As mentioned above, each rolling unit 5 of the rolling mill 1 has linear guides 15 which extend transverse the rolling axis L and lie in a plane inclined at an angle a of 30° to a horizontal plane extending through the aforementioned rolling axis; moreover, the guides 15 of one unit extend from the opposite side of the rolling mill to those of the adjacent rolling unit.

As will become clearer from the following description, the direction in which the guides 15 extend and, more generally, that in which a roll carrier 10 slides, are advantageously parallel to the axis of rotation A1, A2, or A3 of one of the rolls 27, 28 and 29.

This latter fact, together with the arrangement of the rolls and of the respective adjustment devices just mentioned, enables the roll carriers of all of the rolling units to be identical to one another and the outer structure of each rolling unit with the guides mounted thereon, together with the carriers housed inside them, to be formed as those of an adjacent rolling unit in the rolling mill tilted about the vertical axis V extending through the axis L.

Each roll carrier 10 has wheels 48 to facilitate its running along the guides 15 and, beside each rolling unit, on the side on which the guides 15 extend, there is a device 50 for loading-unloading roll carriers, associated with an extractor 45; the latter is constituted essentially by a thrust element acting parallel to the guides 15 and having an engagement end 45*a* which engages an appendix 46 of matching shape on the roll carrier.

The loading-unloading device 50 of each rolling unit has a carriage 51 movable on rails 52 parallel to the rolling axis L; the carriage 51 has two tiltable platforms 53 and 53*a* operated by respective oleodynamic lifters 54. On the platforms 53 and 53*a* there are pairs of linear guides 55 and 55*a* which, when the corresponding platform 53 or 53*a* is tilted through an angle of 30° relative to a horizontal plane extending through the rolling axis, are coplanar with the guides 15 of the associated rolling unit.

A mandrel-support apparatus 80 with which the rolling mill of the invention is provided will now be described with reference to FIGS. 6, 7 and 8; more precisely, the rolling mill has several of these devices disposed between two rolling units 5 of the rolling mill and close to the input end 6 and to the output end 7 for the pipes being processed.

The apparatus 80 comprises a substantially L-shaped body 81 which can swing transversely relative to the rolling mill and in which there is a seat 86 where three idle mandrel-support rolls 82, 83 and 84 are journalled, these rolls being mounted in association with an articulated system 85 causing them to move from an operative position in which they support a mandrel extending through the apparatus, to an inoperative position in which the rolls are moved away from the rolling axis so as not to interfere with a pipe during rolling.

The apparatus 80 also includes a stop element 87 for keeping the swinging body 81 in an operative position, that is, in a position in which the seat 86 is concentric with the axis L so that the rolls 82, 83, and 84 can be arranged circumferentially on a mandrel interposed between them, and a rest position in which the body 81 is moved away from the rolling axis. It is hardly necessary to point out that the swinging movement of the body 81 is brought about by means of a hydraulic actuator 88 but, naturally, could be achieved by any other suitable means.

Finally, it should be borne in mind that the rolls 27, 28 and 29 of each rolling unit 5 are driven by respective independent motors 90 together with drive extensions 91, the latter being connected mechanically to the former by couplings, not shown in detail in the drawings, which enable the extensions to be moved axially by means of the hydraulic actuators M, as will be explained further in connection with the operation of the invention which will be described below; before proceeding with this description, it is stated solely that, in the rolling mill of the invention, there are means for adjusting and controlling the various rolling stages, that are not described in detail and the functions of which can in any case be inferred from the explanation given below.

A pipe to be rolled is inserted from the input end 6 of the rolling mill, fitted on the mandrel 40; it is then advanced along the rolling axis by the rotation of the rolling rolls of each unit with which it comes into contact in succession. More particularly, the rolls of each rolling unit are held in predetermined positions by the combined effect of the biasing means 34 and of the adjustment device 30, 31, 32, the movable portions of which act on the spacers 24*a*, 25*a*, 26*a* of the corresponding support elements 24, 25, 26.

When a pipe being rolled, fitted on the mandrel, encounters the rolls of a rolling unit, it therefore exerts a radial force which is transmitted by means of the support elements 24, 25, 26 and the respective spacers to the movable portions of the adjustment devices 30, 31, 32, so as to be discharged, by means of the fixed portions thereof, onto the outer load-bearing structure constituted, in this case, by two adjacent plate-like elements 3.

Since these elements 3 have closed cross-sections, that is, cross-sections taken in a plane perpendicular to the rolling axis, the outer structure of each rolling unit formed thereby is best able to withstand the aforementioned rolling stresses, thus contributing to the achievement of the first part of the object set at the beginning.

With regard to the replacement of the rolls for the rolling units, this takes place as follows.

The means for clamping a carrier in its working position which is occupied during rolling are released so that a roll carrier 10 can slide along the guides 15 of the respective unit; at this stage, the biasing means 34 are also de-activated and those associated with the arm 20 in particular are translated so as not to interfere with the carrier to be removed.

Similarly, the extensions 91 for driving the rolls are also disconnected therefrom and are retracted axially by the hydraulic actuators M so as to be moved out of the roll carrier. In this situation, the adjustment device 31 is placed in the retracted position relative to the guides 15 so as not to interfere with the movement of the carrier along them.

The thrust element 45 is activated to move the roll carrier to be removed along the guides 15 until it is brought to their ends where the platform 53 of the carriage 51 associated with the rolling unit has in the meantime been tilted; the carrier is then placed on the tilted platform and, after it has been fully loaded thereon, the lifter 54 is lowered so as to bring the platform, with the roll carrier resting on it, to a horizontal position.

The carriage 51 is then advanced so as to bring the second platform 53*a*, on which the new roll carrier to be inserted is disposed, to a position such that the guides 55*a* are in alignment with those of the roll unit; the new carrier is then inserted in the rolling unit in the place of that to be replaced by the repetition, in reverse, of the steps just described for the removal of the carrier to be replaced.

It can be understood from the foregoing that this method of carrying out the roll-changing operation achieves the other part of the object set at the beginning.

In fact, this roll-changing operation now takes place at the side of the rolling mill and thus without requiring a large space downstream thereof as was, however, the case with axial sliding of the roll carriers envisaged in the prior art.

Finally, this result is achieved by virtue of the provision of a passage in the outer structure, for each rolling unit, through which the carrier can come out, but without substantial alteration of the annular configuration of the outer structure.

Many advantageous effects are achieved by the invention.

Amongst these, it should be pointed out that, by virtue of the fact that the roll-changing is carried out alternately on one side of the rolling mill and on the other for each rolling unit contained therein, a replacement roll carrier for each unit can be provided at the side of the rolling mill, without interfering with the removal of another carrier from the structure.

In fact, if the roll-changing operation were to take place from a single side of the rolling mill, it would not be possible to provide a replacement carrier beside each rolling unit; in other words, if roll-changing were carried out from only one side of the rolling mill, this operation would have to be carried out either by removing first all of the roll carriers from the rolling mill and subsequently moving them away from the mill in order then to be able to load the new replacement roll carriers, after they have been brought to a position beside the corresponding rolling units, or by removing one carrier individually and then inserting the replacement one, for each rolling unit. Both of these solutions are less favourable than that proposed by the invention.

Another advantageous aspect to be emphasized with regard to the embodiment of the invention considered herein lies in the individual motorization of each roll of a rolling unit, that is, the use of an independent drive for each roll, by virtue of which it is possible to avoid the presence of complicated transmission mechanisms beside the rolling mill, thus creating the space necessary to allow the carriers to be removed and handled as described above.

More generally, with regard to the driving of the rolls 27, 28, 29, if the number of rolling units is not too high, it is preferable to use independent drive means for each roll (bearing in mind that it is in any case possible to use two or more motors for driving a single roll) whereas in large rolling mills, the possibility of the rolls belonging to several rolling units but having parallel axes of rotation being driven by a single kinematic mechanism driven by common drive means should not be excluded. It is important, however, for achieving the results set out above, that one roll of a rolling unit be driven independently of the other two rolls.

Figure 4:
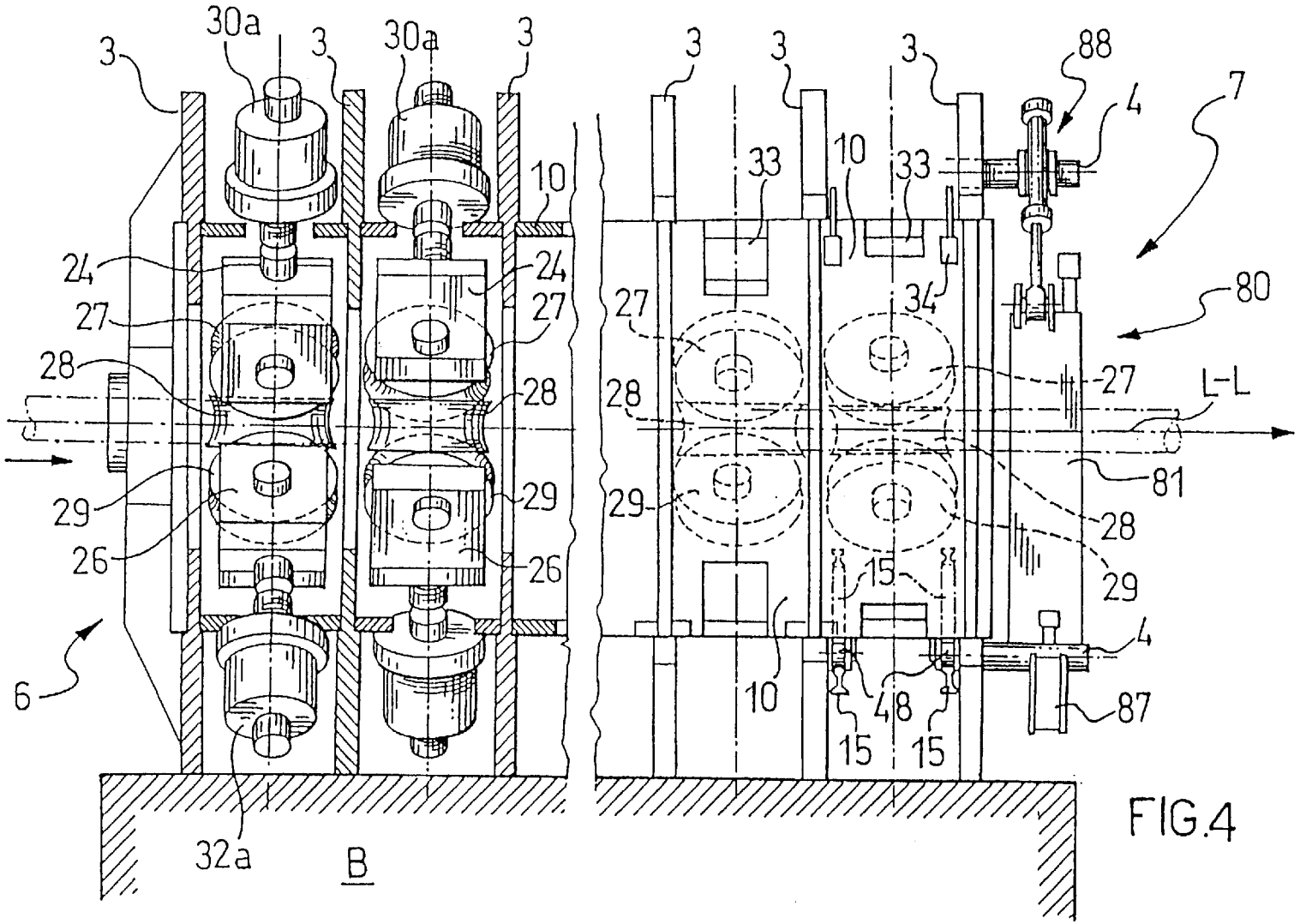
FIG. 4 is a side view of the above-mentioned rolling mill.

A further and considerable advantage achieved by the invention lies in the fact that the axial stresses which arise during rolling, that is, the stresses having resultants parallel to the rolling axis L and which, although smaller than the radial stresses considered above, may assume quite significant values, are absorbed by the outer structure of each rolling unit. In order better to understand this effect, it is necessary to consider that the axial stresses mentioned tend to displace the support elements of the rolls, and consequently also the respective roll carriers, in the direction of advancement of the pipe along the rolling axis L; as shown in FIG. 4, the tendency of each support element 24, 25 or 26, as well as that of the carrier itself, to move is limited by the plate-like elements 3 adjacent the carrier 10 on which each roll is mounted. On this point, it should be stated that the tendency of each support element and of the roll carriers to move, as well as the restraining effect of the plate-like elements 3 on this movement, can take place both when the arms 19, 20, 21 pivot in a plane perpendicular to the rolling axis L and in the alternative embodiment mentioned above, wherein the arms are configured so as to pivot in radial planes extending through this rolling axis.

It can easily be understood from the foregoing that, by virtue of the particular structural configuration and the effects achieved thereby, in the rolling mill of the invention, the axial stresses are distributed over all of the rolling units, unlike the rolling mill described in application MI92A000917, wherein these stresses were withstood by suitable means provided at the end of the rolling mill; the rolling units of the invention and the rolling mill formed thereby thus enable the means provided in the prior art to be eliminated, simplifying the construction of the rolling mill.

It should also be pointed out that, in the other prior art application No. MI93A000704 considered, diaphragms 9 in the form of large plates were provided for withstanding the axial stresses and the displacement of the support elements mentioned above; this was implied by the "C"-shape, that is open-sided, structure which did not permit an effective action such as that which can, however, be achieved by the annular configuration of the structure of the present invention. The simplification achieved by the present invention is also clear in this case.

Another advantage achieved by the present invention that should be stressed is connected with the inclination to a horizontal plane of the sliding axes of the carriers which, together with the particular configuration of the rolling units with their roll carriers, both derived from their rotation relative to the vertical axis according to the teaching already described, achieves the substantially symmetrical and compact construction of the rolling mill as a whole shown in the drawings; this construction also includes the parts of the rolling mill which are outside the structure 2 such as, for example, the rails 52 and the carriages 53, and the motors 90 with the extensions 91, and thus contributes significantly to the limitation of construction costs.

The advantageousness of the provision for the sliding axes of the carriers, and thus also the guides 15, to be parallel to the axis A1, A2 or A3 of one of the rolls should also be noted; it can in fact be understood from an observation of the drawings that, with this solution, a carrier 10 can be removed from its opposite side to that on which one of the drive extensions is engaged, that is, a side where there are no obstructions to the sliding of the carrier and where a carriage can be disposed. Moreover, this inclination also clearly enables a carrier to be housed firmly in the respective structure owing to its own weight which tends to keep it therein, favouring its correct attitude during rolling.

In this context, the advantageous effects achieved by the mandrel-support apparatus 80 described should also be pointed out.

This apparatus has the function of enabling the mandrel to move inside the rolling mill in the complete or partial absence of a pipe, for example, when a mandrel from which a rolled pipe has been removed is returning from the output end 7 to the input end 6 of the rolling mill; in this situation, in fact, the rolls 82, 83, 84 of the apparatus 80 are arranged to keep the mandrel in a position concentric with the space defined by the rolls 27, 28 and 29 of the rolling units which, as already stated, are kept spaced from the rolling axis L by the biasing means 34; in other words, the mandrel-support apparatus 80 provided in the rolling mill shown in the drawings, prevent the mandrel from knocking against the rolls of the rolling units during its movement in the absence of a pipe.

Figure 6:
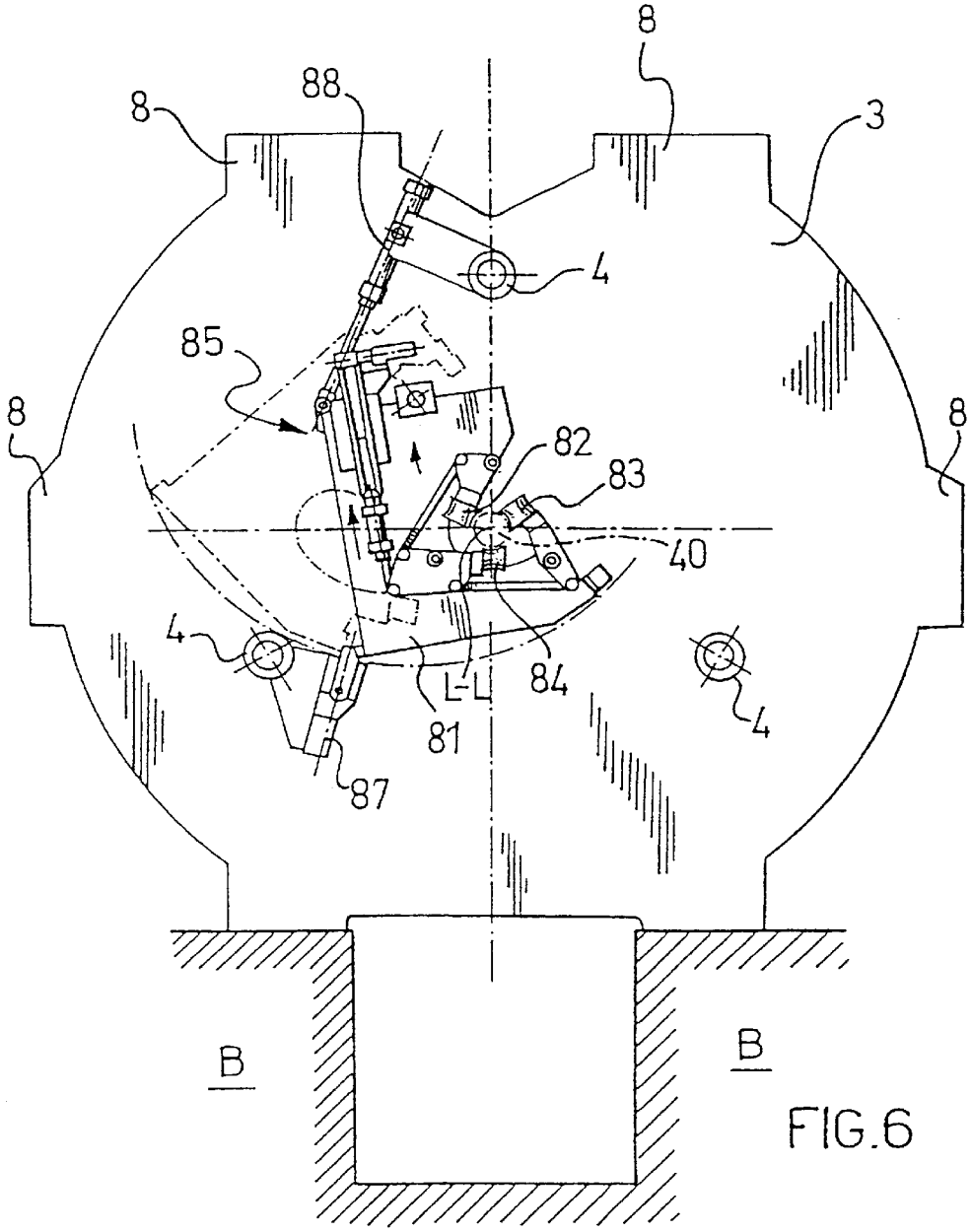
Figure 8:
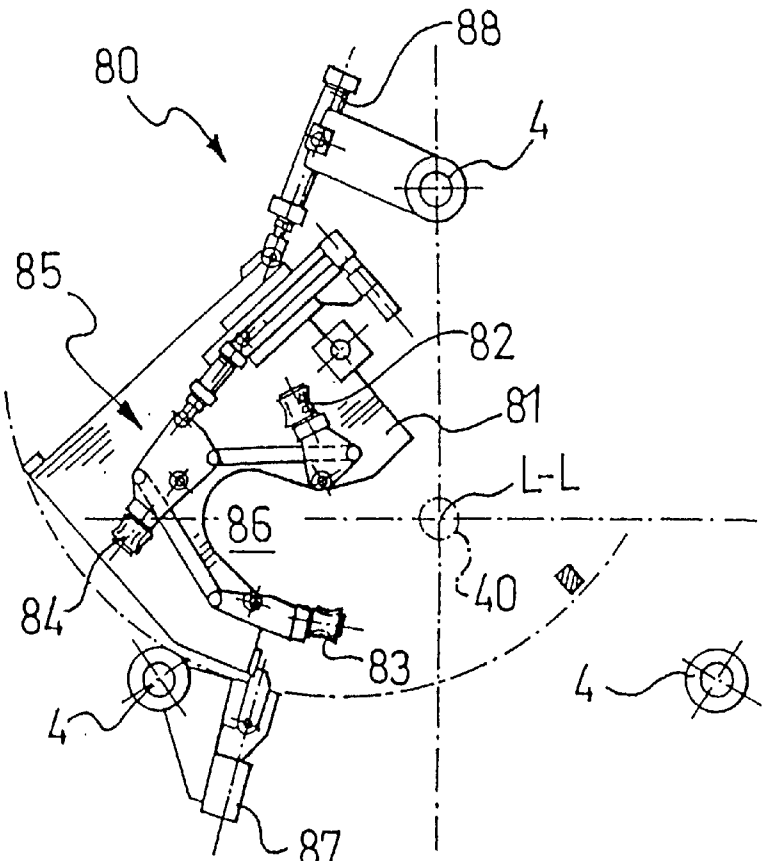
Figure 7:
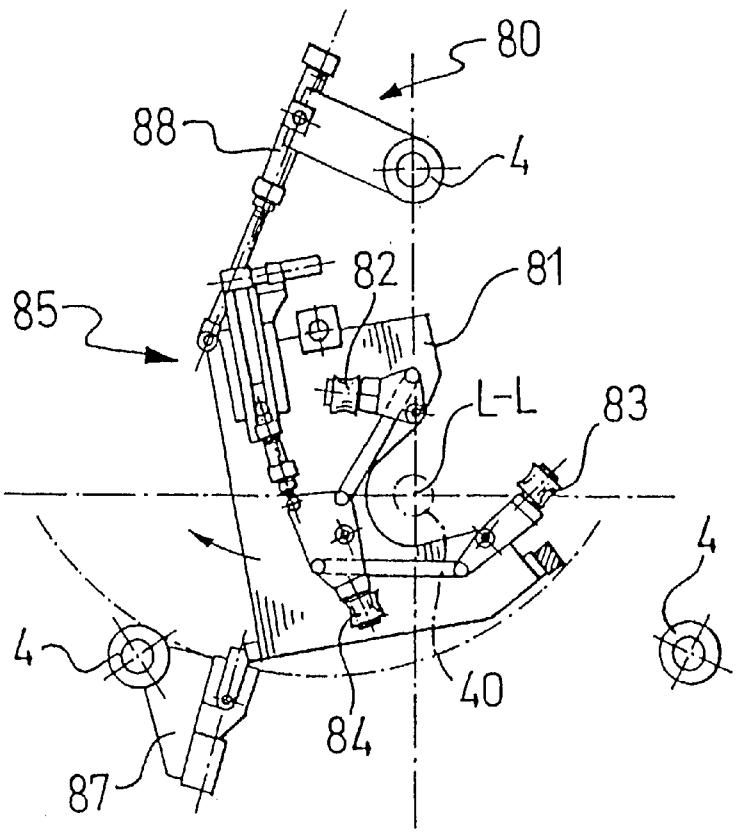

Mandrel-support apparatuses which perform this function already exist in rolling mills of the prior art; however, the particular feature of that shown in FIGS. 6, 7 and 8 is that it can be moved away from the rolling axis L even during rolling. This capability is particularly advantageous when conditions arise in which the advance of the pipe and of the mandrel is blocked in the rolling mill during the rolling of a pipe; in these eventualities, it is in fact necessary to gain access to the interior of the rolling mill to carry out the necessary maintenance. Since, in such circumstances, it would clearly not be possible to remove the roll carriers from the structure, given the presence of the pipe and of the mandrel among the rolls, it is necessary to be able to create sufficient space between one rolling unit and another disposed beside in the rolling mill to permit the intervention of an operator.

As shown in FIGS. 6, 7 and 8, once the articulated system 85 has moved the rolls 82, 83, 84 away from the rolling axis, the mandrel-support apparatus 80 can be moved relative to the mandrel with the pipe fitted on it, which are clamped in the structure 2 of the rolling mill, thus providing a space which can be used for access by a maintenance operator.

It should in any case be pointed out that this mandrel-support apparatus could be formed in a manner other than that considered herein; that is, it is not strictly necessary for it to have a swinging body such as that described, but it will suffice for it to have a configuration such as to enable it to be removed transverse the rolling axis; in practice, it will therefore only be necessary that the seat of it where the rolls are disposed be open on an axis transverse the rolling axis L, along which the device can be moved towards or away from the rolling axis, naturally after the rolls have been spaced therefrom.

Naturally, other variants of the invention as described hitherto are possible.

For example, it should not be excluded that the configuration of the mill wherein the plate-like elements 3 are connected rigidly to one another by the tie rods to form the structure of two adjacent units, could be replaced by a configuration of the rolling mill in which the various rolling units are spaced apart; in other words, the formation of the rolling mill with a plurality of units 5 disposed side by side along the rolling axis but with their outer structures separate from one another, naturally with the characteristics of each unit necessary to achieve the object for which they were designed remaining unchanged, should not be ruled out.

Furthermore, it is also pointed out that the adjustment devices 30, 31, 32 mentioned above may be either hydraulic or electromechanical or of another kind; if they were electromechanical, they could be formed in a manner such that the fixed portion 30*a*, 31*a*, 32*a* and the movable portion 30*b*, 31*b*, 32*b* would together form a helical kinematic pair; in this case, the alternate movement forth of the movable portion described above would also be accompanied by a rotary movement thereof which would not, however, alter its effects which were pointed out above.

Finally, the use of the invention for purposes other than those envisaged, for example, for rolling pipes without a mandrel, or bars, rods, or rod-shaped bodies in general should also not be excluded.

These and other possible variants, however, fall within the scope of the teaching which is based on the invention as can be inferred from the description given thereof and from the following claims.

We claim:

1. A unit for rolling pipes on a mandrel comprising a closed, substantially annular, outer structure arranged along a rolling axis, a roll carrier housed in said structure, three driven rolls having axes of rotation transverse to said rolling axis, a device mounted on said outer structure and associated with each said roll for regulating a distance of said axis of rotation of each said roll from said rolling axis, wherein said roll carrier is guided for sliding movement between an operative position in which it is locked in the outer structure and an inoperative position in which it is removed therefrom along a direction substantially transverse to said rolling axis, said outer structure for allowing said carrier to pass along said transverse removal direction and means being provided in said rolling unit for effecting said sliding movement.

2. A rolling unit according to claim 1 wherein said outer structure comprises at least two platelike elements substantially in the form of closed rings, connected rigidly to one another by means of a plurality of tie rods.

3. A rolling unit according to claim 1 wherein said rolls are mounted on lever arms that pivot in a plane perpendicular to said rolling axis.

4. A rolling unit according to claim 1 wherein said rolls are mounted on lever arms that pivot in respective radial planes perpendicular to the axis of rotation of the corresponding roll and passing through said rolling axis.

5. A rolling unit according to claim 1 wherein said removal direction of said carrier is inclined to a substantially horizontal plane extending through said rolling axis.

6. A rolling unit according to claim 5 wherein the angle of inclination of said removal direction is about 30°.

7. A rolling unit according to claim 1 wherein each roll is driven independently of the other two.

8. A rolling mill for rolling pipes on a mandrel comprising a plurality of rolling units according to claim 1 arranged side by side along said rolling axis.

9. A rolling mill according to claim 8 wherein said outer structures said rolling units are connected rigidly to one another forming a single outer structure of said rolling mill.

10. A rolling mill according to claim 8 wherein in the operative position, said roll carrier of each rolling unit is arranged beside said unit, and the inoperative position of a roll carrier of one unit is on the side of said rolling mill opposite to the inoperative position of a carrier of the adjacent rolling unit.

11. A rolling mill according to claim 10 wherein said removal directions of said roll carrier relating to inoperative positions thereof which are on the same side of the rolling mill, lie in respective planes inclined at about 30° to a substantially horizontal plane extending through said rolling axis.

12. A rolling mill according to claim 8 wherein said rolling units are identical to one another and each is rotated with respect to the one beside it in the rolling mill, about a vertical axis crossing said rolling axis.

13. A rolling mill according to claim 11 wherein said means for the removal of a roll carrier comprise, for each rolling unit, a thrust element acting on said carrier along its sliding axis, and wherein said means comprise, for each rolling unit, a loading-unloading device which includes a carriage movable on rails parallel to said rolling axis and having at least one platform tiltable from a horizontal position to an inclined position for receiving a roll carrier pushed onto it by said thrust element.

14. A rolling mill according to claim 8 which comprises at least one mandrel-support apparatus having a body with a seat wherein a plurality of rolls are journalled and are movable away from and towards said rolling axis between a working position in which they support a mandrel disposed along the rolling axis and a position in which they are removed away from this axis, said seat being open in a direction substantially transverse to said rolling axis, whereby said mandrel-support apparatus can be removed from said rolling mill when its rolls are in the removed position.

15. A rolling mill according to claim 14 wherein said body is substantially "L"-shaped and is swingable about an axis parallel to said rolling axis.

16. A rolling mill according to claim 8 wherein each roll of a rolling unit is driven independently of the other two by means of at least one respective motor.

17. A rolling mill according to claim 9 wherein in the operative position, said roll carrier of each rolling unit is arranged beside said unit, and the inoperative position of a roll carrier of one unit is on the side of said rolling mill opposite to the inoperative position of a carrier of the adjacent rolling unit.

18. A rolling mill according to claim 9 wherein said rolling units are identical to one another and each is rotated with respect to the one beside it in the rolling mill, about a vertical axis crossing said rolling axis.

19. A rolling mill according to claim 12 wherein said means for the removal of a roll carrier comprise, for each rolling unit, a thrust element acting on said carrier along its sliding axis, and wherein said means comprise, for each rolling unit, a loading-unloading device which includes a carriage movable on rails parallel to said rolling axis and having at least one platform tiltable from a horizontal position to an inclined position for receiving a roll carrier pushed onto it by said thrust element.

20. A rolling mill according to claim 18 wherein said means for the removal of a roll carrier comprise, for each rolling unit, a thrust element acting on said carrier along its sliding axis, and wherein said means comprise, for each rolling unit, a loading-unloading device which includes a carriage movable on rails parallel to said rolling axis and having at least one platform tiltable from a horizontal position to an inclined position for receiving a roll carrier pushed onto it by said thrust element.

* * * * *